US005584142A

United States Patent [19]

Spiess

[11] Patent Number: 5,584,142

[45] Date of Patent: Dec. 17, 1996

[54] THRESHOLD PROFILE MEMBER FOR THE GUIDANCE OF DOOR LEAVES

[75] Inventor: Peter Spiess, Meggen, Switzerland

[73] Assignee: Inventio AG, Hergiswil, Switzerland

[21] Appl. No.: 491,565

[22] Filed: Jun. 16, 1995

[30] Foreign Application Priority Data

Jun. 28, 1994 [CH] Switzerland ..... 02050/94

[51] Int. Cl.[6] ..... E05D 13/00; E05D 15/16

[52] U.S. Cl. ..... 49/411; 49/409; 49/410

[58] Field of Search ..... 16/93 R; 49/404, 49/408, 409, 410, 411, 505, 467, 468, 471

[56] References Cited

U.S. PATENT DOCUMENTS 3,368,235 2/1968 McClean .
4,680,828 7/1987 Cook et al. .

FOREIGN PATENT DOCUMENTS 0532347 3/1993 European Pat. Off. .
8909869 11/1989 Germany .
1594330 12/1976 United Kingdom .

*Primary Examiner*—Kenneth J. Dorner
*Assistant Examiner*—Curtis A. Cohen
*Attorney, Agent, or Firm*—Greenblum & Bernstein P.L.C.

[57] ABSTRACT

Threshold profile member for the guidance of door leaves. The threshold profile member is built in a modular manner and comprised of guide profile members, spacers and separators, with two oppositely directed guide profile members and a spacer together forming a guide groove, with the separators serving for adjustment relative to the door leaf, the latter being provided with slide members and supports, in a recess provided in a building, with the guide profile members, spacers and separators being frictionally interconnected with the door leaf thickness and door gap being adjusted via the use of different separators, with the spacers being arranged only in the region of a screw connection, in order to ensure maintenance of the guide groove width, with the spacers and the separators being horizontally inclinable relative to a door frame side and the separators optionally being comprised of a tough transparent material for the mounting thereunder of lighting and/or information display purposes.

16 Claims, 3 Drawing Sheets

THRESHOLD PROFILE MEMBER FOR THE GUIDANCE OF DOOR LEAVES

CROSS REFERENCE TO RELATED APPLICATIONS

This application claims the priority of Swiss Application No. 02 050/94-5, filed Jun. 28, 1994, the disclosure of which is incorporated herein by reference in its entirety.

BACKGROUND OF THE INVENTION

1. Field of the Invention

The invention relates to a threshold profile member for the guidance of door leaves or panes of sliding doors, used for example in elevator constructions or the like, wherein the member is recessed into the floor below the doors, wherein supports are mounted at the door leaves and slide members, fastened to the supports, run in guide grooves.

2. Discussion of the Background of the Invention and Material Information

A system of threshold profile members is set forth in European Patent Publication EP 0 532 347 A1, which system is clamped into recesses provided in the building. In that system, the flexible plastic profile member, which is held in place by the clamping effect, serves as a guide rail for guide pins fastened to the door leaves of a sliding door. The profile member is so constructed that dirt or foreign bodies do not block the guide pins, but drop into the interior space of the profile member, which is constructed to be larger than the guide slot. A worn out or highly soiled profile member is removed from the recess and replaced by a new one.

The disadvantages of the foregoing threshold profile member lies in that the guide surfaces are directly subjected to contamination. In addition, due to the noted fastening manner, constraints are imposed upon the choice of material. Adjustment of the threshold profile member, during positioning of the door leaves provided with guide pins, is associated with considerable effort. Moreover, in the case of wear-out or contamination, the entire plastic profile member must be replaced.

It is the task or object of this invention to produce a threshold profile member, of the initially described type, which does not have the disadvantages thereof and which enables simple adjustments to a door leaf that is provided with guide elements.

SUMMARY OF THE INVENTION

This task or object is achieved in accordance with this invention, specifically via a threshold profile member for the guidance of door leaves of sliding doors, wherein the member is installed into the floor below the doors, wherein supports are mounted on the door leaves, and wherein slide members, fastened to the supports, run in guide grooves, the threshold profile members being built up in a modular manner and comprised of guide profile members, spacers and separators parallel to the door leaves and mutually abutting on their longitudinal sides, and being interconnected via frictional engagement.

In a further embodiment of the threshold profile member of this invention the guide profile member is comprised of a commercial C-section rail, an L-section rail, or of appropriately formed sheet metal.

In another variation of the threshold profile member of this invention two oppositely directed guide profile members combine to form a guide groove.

A differing variation of the threshold profile member of this invention further includes a screw connection for connecting the profile members, the separators and the spacers, wherein the spacers are mounted only in the region of the screw connection.

In yet a further embodiment of the threshold profile member of this invention the spacers extend over the entire length of the threshold profile members.

In yet another variation of the threshold profile member of this invention the spacers and/or the separators are horizontally inclined relative to one side of the door frame.

In a differing variation of the threshold profile member of this invention the guide profile members further include a guide insert having one of an abrasion-proof and highly-polished surface, preferably comprised of ceramic or Ni-Cr steel material.

In a still further variation of the threshold profile member of this invention the separators are comprised of a tough transparent material having threshold lighting and/or information display material arranged thereunder, the material preferably being PLEXIGLASS.

The advantages achieved by the invention are essentially in that, via modular construction, the maintenance or replacement of the threshold section is greatly simplified. A considerable freedom of choice of material is achieved by virtue of the use of simple profile members of appropriately formed sheet metal for use as guide rails and for the separators mounted therebetween. Adjustments to the panel thickness of the door leaf are effected merely via the use of different thickness separators. Tolerances in the floor recesses can be easily compensated. Moreover, the guide surfaces are protected from direct contamination.

Advantageous developments and improvements of the threshold members are set forth in the structures recited in the appended claims. In the case of outdoor applications or fire department elevators or lifts, water drainage can be ensured in a simple manner via inclination of the separators. In addition, the separators can also consist of transparent materials having threshold lighting or information displays disposed thereunder. Via the utilization of modular construction, an individual matching of the length of the profile members and the separators to the shaft frame is readily possible.

BRIEF DESCRIPTION OF THE DRAWINGS

The invention, which will be described with reference to three embodiments thereof, will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

Figure 1:
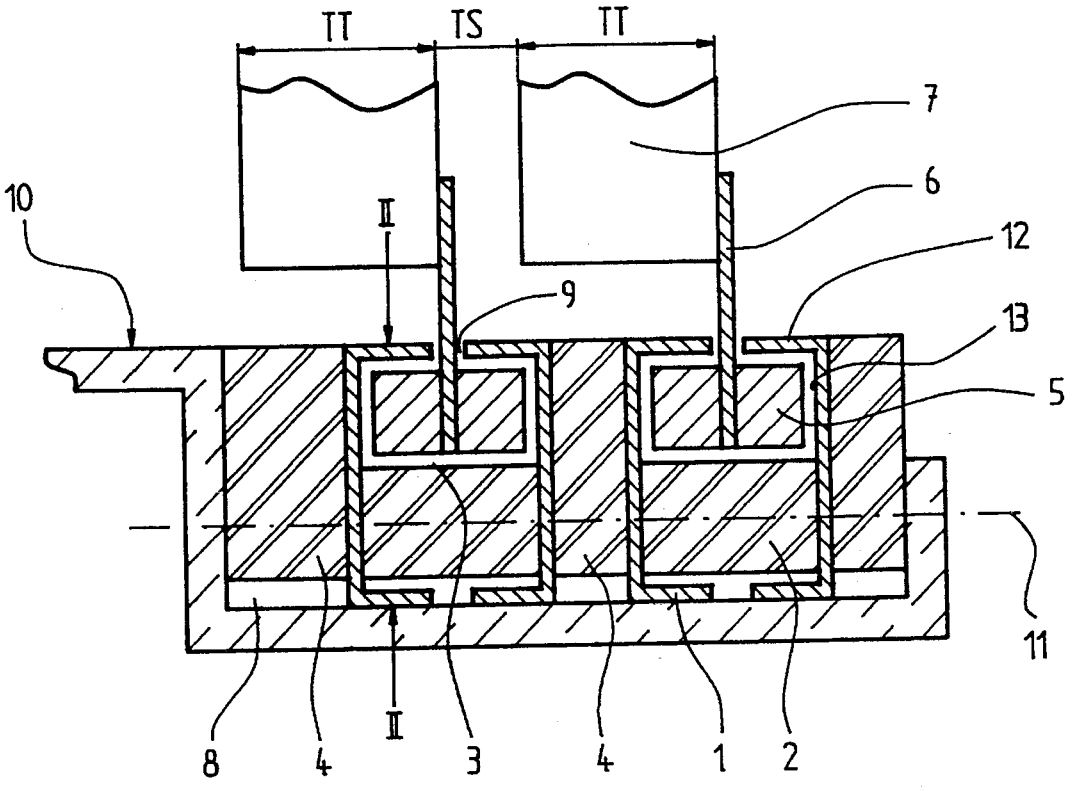
FIG. 1 shows a modular threshold profile member in cross section.

FIG. 1 shows a modular threshold profile in cross section. Each of two oppositely directed guide profile members 1 and a spacer 2 together form a guide groove 3. Distance pieces or spacers 4 serve for adjustment to the door leaves or panes 7, which are provided with slide members 5 and supports 6, in a recess 8 provided in a building or construction site in a story floor, such as for example a concrete floor. Guide profile members 1, spacers 2 and separators 4 are preferably connected together by means of frictional engagement. The dimensions of floor leaf depth or thickness TT and door aperture or gap TS, which are variable due to the desired panelling and rigidity of the door leaf, are adjusted via the use of different separators 4. The opening 9, formed by the two guide profile members 1, is kept so narrow that goods (e.g., elevator doors), which are to be transported on rollers, can readily be moved. Separators 4 extend over the entire length of the threshold profile member. The upper edges of separators 4 are flush with guide profile members 1 and floor level 10. Spacers 2 are arranged only in the regions of screw connections 11, consisting of a screw or threaded rod and nuts, in order to ensure the maintenance of the width of guide groove 3. Moreover, through this arrangement, additional space is made available for dirt falling through opening 9. As a variation, the spacers can also extend over the entire length of the threshold profile member. The guide profile members 1 are preferably made of commercial type C-section rails or L-section rails or consist of suitably formed sheet metal. The guide surfaces 13 of guide rail members 1 are protected from contamination by laterally extending tabs 12. By virtue of the use of profile members of formed sheet metal, the width of guide groove 3 can be enlarged to such an extent that rollers can be used instead of slide members 5. The removal of the separators 4 or of spacers 2, after loosening of screw connection 11, facilitates the upkeep and replacement of guide profile members 1 and slide members 5. Separators 4 consist of a resistant or tough material (for example aluminum). A further possibility consists in that separators 4 are made of a transparent material (for example PLEXIGLASS or the like), with threshold lighting and/or an information display arranged thereunder. The information display can indicate a company logo or actual lift or elevator data (waiting time reserved call, etc.), for example.

Figure 2:
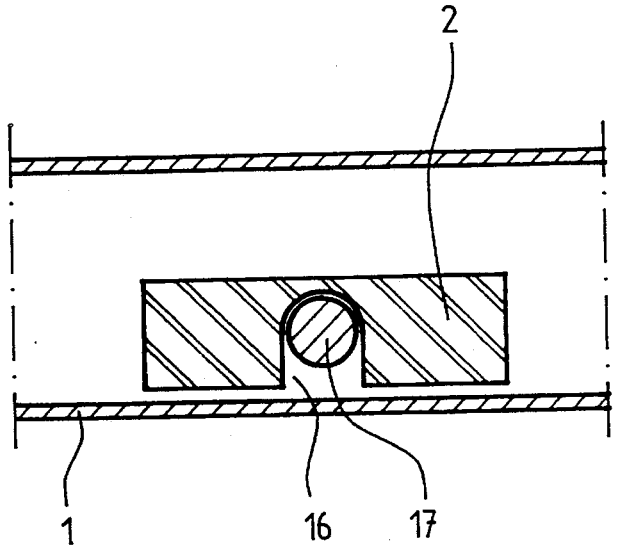
FIG. 2 shows a section, taken along line II—II of FIG. 1, through a spacer, in the region of the fastening.

FIG. 2 shows a longitudinal section through a spacer 2 in the region of the fastening. Guide profile member 1, spacers 2 and separators 4 have, in the region of the fastening, a slot or groove 16 for the reception of a screw 17. The access for removing and attaching the modular threshold profile member by means of screw 17 takes place at the shaft side. Through the assembly from individual elements, which are simply variable in length, the threshold profile members can be individually fitted to each shaft form or profile in a relatively simple mode and manner.

Figure 3:
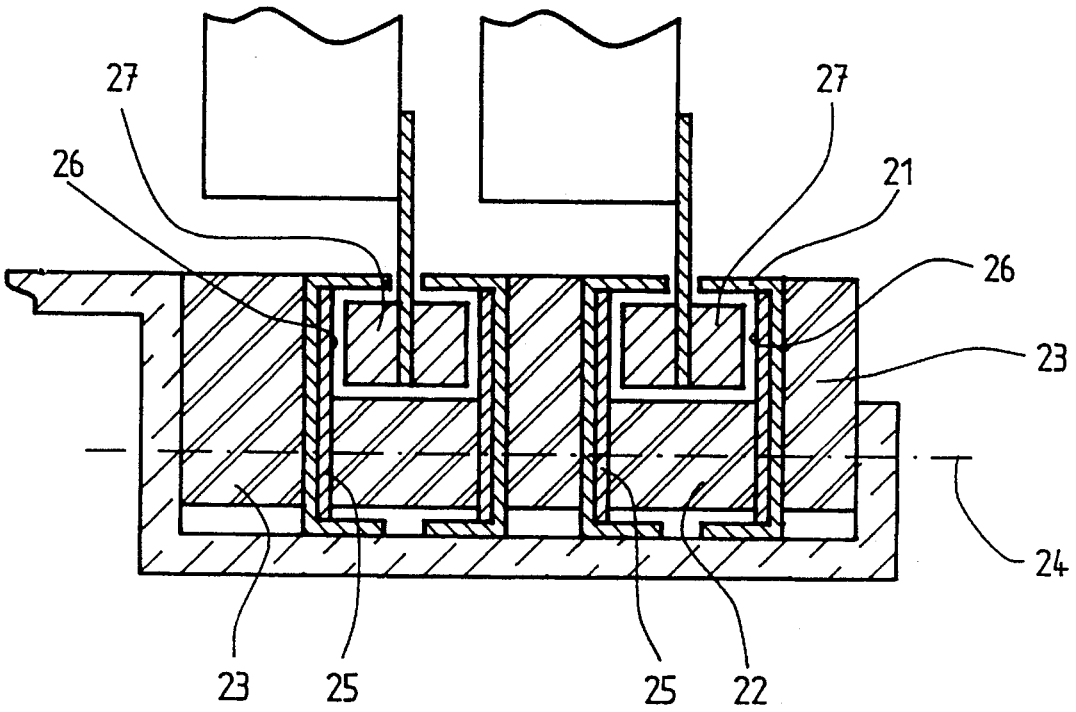
FIG. 3 shows, in cross section, in accordance with a second embodiment of this invention, a modular threshold profile member with additional guide inserts.

FIG. 3 shows a second embodiment of a modular threshold profile member. The arrangement of guide profile members 1, spacers 22 and separators 23, as well as the fastenings, via a screw connection 24, is in accordance with that of FIG. 1. As an addition, guide profile members 1 contain guide inserts 25 having abrasion-resistant or highly polished surfaces 26 (for example, of ceramic or Cr-Ni steel). This enables better sliding of slide members 27 and reduces the wear of the elements participating in the sliding process.

Figure 4:
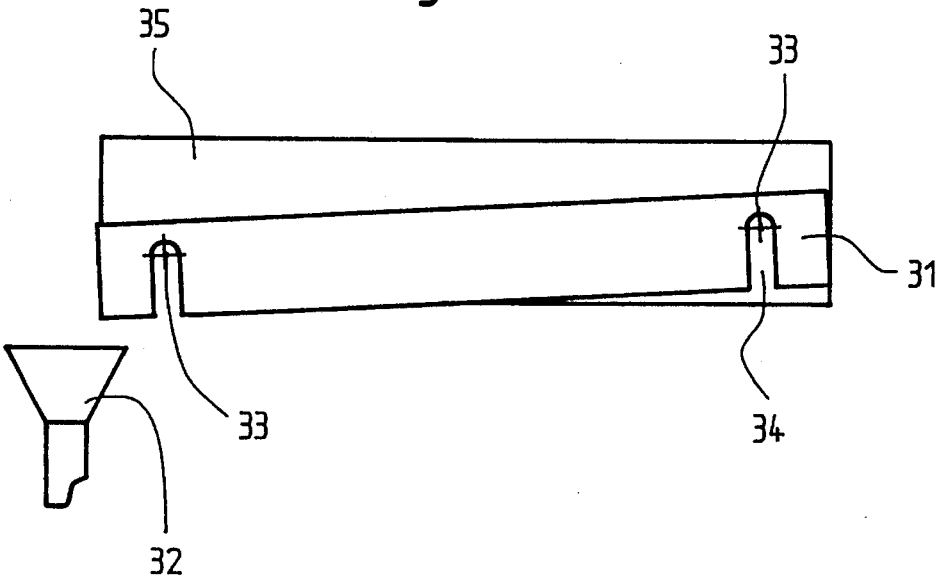
FIG. 4 shows, in cross section, in accordance with a third embodiment of this invention, a modular threshold profile member that is able to cope with wetness.

FIG. 4 shows a third embodiment of a modular threshold profile member in longitudinal section. The arrangement and fastening of the elements is realized in accordance with that of FIG. 1. This variation, however, relates to an embodiment able to cope with wetness, such as for outdoor use or for fire department elevator use or for ease of cleaning of the profile members. For this purpose, spacers 31 are mounted over the entire length of the threshold profile member. In addition, spacers 31 are provided with an inclination, so that water, which penetrates same, flows off to the door frame side and can be collected by way of a water drain 32. As a variation, separators 23 can also be provided with an inclination. In order to effect the inclination of spacer elements 31 and separators 23, screw connections 33 are mounted at different heights or a slot 34, in spacer 31 and separators 23, can be so formed that an inclination can also be achieved through screw connections 33 mounted at the same height. In order to achieve better sliding properties, guide profile members 35 can also be supplemented in accordance with the teachings of FIG. 3.

Figure 5:
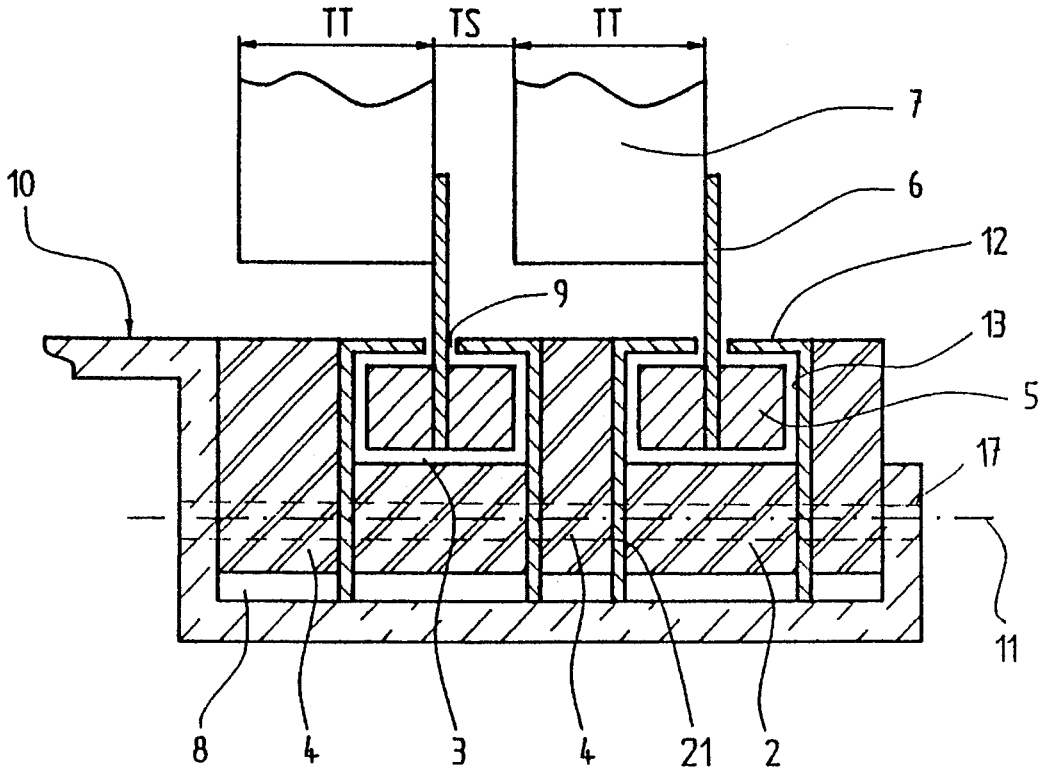
FIG. 5 shows, in cross-section, an alternative embodiment of a modular threshold profile member.

FIG. 5 shows an alternative embodiment of the present invention. In the alternative embodiment to that shown in FIG. 2, the C-shaped profiles 1 may be replaced with L-shaped profiles 21. Accordingly, L-shaped profiles 21 may be inserted into the threshold profile as guide members. Since the recess 8 in the floor of the building offers a smooth surface upon which to position the individual elements of the present invention, no practical problems arise in this alternative arrangement of the elements.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. A threshold profile member for the guidance of door leaves of sliding doors, each door leaf including at least one slide member and at least one support for fastening the at least one slide member to the door leaf, said threshold profile member for positioning within a floor below the sliding doors, said threshold profile member comprising:

a plurality of guide profile members forming a plurality of grooves, each of said grooves for receiving the supports associated with a respective one of the leaf doors and each of said guide profile members for receiving the slide members associated with the respective one of the leaf doors;

a plurality of spacers and a plurality of separators;

wherein each of said plurality of spacers is positioned within each of said plurality of guide profile members, and each of said plurality of separators is positioned between adjacent guide profile members, and wherein said plurality of guide profiles, said plurality of spacers and said plurality of separators are interconnected via frictional engagement.

2. The threshold profile member of claim 1, each of said plurality of guide profile members comprising a pair of C-section rails.

3. The threshold profile member of claim 1, each of said plurality of guide profile members comprising a pair of L-section rails.

4. The threshold profile member of claim 1, each of said plurality of guide profile members comprising formed sheet metal.

5. The threshold profile member of claim 1 wherein two oppositely directed guide profile members combine to form a guide groove.

6. The threshold profile member of claim 1 further including a screw connection for connecting the profile members, the separators and the spacers, wherein the spacers are mounted only in the region of the screw connection.

7. The threshold profile member of claim 1 wherein the spacers extend over the entire length of the threshold profile members.

8. The threshold profile member of claim 1 wherein said spacers are horizontally inclined relative to one side of a door frame, the incline enabling penetrating water to drain to a lower side of said threshold profile member.

9. The threshold profile member of claim 1 wherein said separators are horizontally inclined relative to one side of a door frame, the incline enabling penetrating water to drain to a lower side of said threshold profile member.

10. The threshold profile member of claim 1 wherein the guide profile members further include a guide insert having one of an abrasion-proof and highly-polished surface.

11. The threshold profile member of claim 10 wherein the guide insert is comprised of ceramic material.

12. The threshold profile member of claim 10 wherein the guide insert is comprised of Ni-Cr steel.

13. The threshold profile member of claim 1 wherein the separators are comprised of a tough transparent material having threshold lighting arranged thereunder.

14. The threshold profile member of claim 1, wherein a separator is positioned on respective outer walls of said guide profile members that are not adjacent another guide profile member.

15. The threshold profile member of claim 1, wherein each of said plurality of guide profile members, spacers, and separators are substantially the same length.

16. The threshold profile member of claim 1, wherein said spacers and said separators are horizontally inclined relative to one side of a door frame, the incline enabling penetrating water to drain to a lower side of said threshold profile member.

* * * * *